United States Patent [19]

Ufferfilge

[11] 4,219,135

[45] Aug. 26, 1980

[54] FOAM SPOUT

[75] Inventor: Roger K. Ufferfilge, Cary, Ill.

[73] Assignee: Seaquist Valve Company, Cary, Ill.

[21] Appl. No.: 747,917

[22] Filed: Dec. 6, 1976

[51] Int. Cl.[2] ..... B65D 83/14

[52] U.S. Cl. ..... 222/402.13; 222/402.23; 222/570

[58] Field of Search ..... 222/402.13, 402.15, 222/402.21, 402.22, 545, 570

[56] References Cited

U.S. PATENT DOCUMENTS

| | | | |
|---|---|---|---|
| 2,836,333 | 5/1958 | Woodel | 222/575 |
| 2,921,722 | 1/1960 | Focht | 222/402.13 |
| 2,982,448 | 5/1961 | Leonard et al. | 222/402.13 X |
| 3,075,709 | 1/1963 | Green | 222/402.13 X |
| 3,195,783 | 7/1965 | Crowell | 222/402.13 |
| 3,325,054 | 6/1967 | Braun | 222/402.13 X |
| 3,373,908 | 3/1968 | Crowell | 222/402.13 |
| 3,539,078 | 11/1970 | Venus | 222/402.13 X |

*Primary Examiner*—Robert J. Spar

*Assistant Examiner*—Fred A. Silverberg

*Attorney, Agent, or Firm*—Stein & Frijouf

[57] ABSTRACT

A foam spout is disclosed for use with an aerosol container having a valve for controlling flow of a product such as a foamable material from the container upon activation of the valve. The spout includes a support having a bottom region engagable with the container and an upwardly extending support wall with a slot. A button member has a conduit including a first conduit portion which is cooperable with the container valve of the container. The button member has a second conduit portion extending through the slot in the support wall of the support. A flexible wall is integral with the support and the button member enabling pivotal movement of the button member relative to the support whereby depression of the button member actuates the valve to cause flow of product through the conduit. The spout is especially suitable for use with aerosol containers having an upwardly extending valve stem which may be frictionally received in the first conduit portion of the button member.

4 Claims, 14 Drawing Figures

FOAM SPOUT

BACKGROUND OF THE INVENTION

1. Field of the Invention

This invention relates to dispensing and more particularly to dispensing of materials under fluid pressure incorporating a valve actuated by a nozzle or through a valve outlet.

2. Description of the Prior Art

Aerosol cans have found wide spread use for dispensing various diverse products in the consumer market. Aerosol cans have been used to dispense liquid products such as paints, and insect repellents; powder products such as deodorants; and foam products such as shaving creams. The selection of the dispensing actuator is determined in part by the state of the product to be dispensed i.e. liquid, powder or foam, in addition to the particular type of product within the aerosol container. A further consideration in the selection of the dispensing article is the intended use of the contained material. A dispensing actuator suitable for spraying a paint product may be unsuitable for spraying an insect repellent or the like.

Articles for dispensing a foam product present a special area of consideration for the manufacturer. Foam actuator articles should be applicable to all foam type products and compatible for use with reliable and standard aerosol can valves. It is also desirable to construct the dispenser actuator of a single mold piece of plastic thereby reducing cost and increasing the reliability of operation of the dispensing article.

The prior art integral dispensing actuators had the disadvantages of requiring a substantial finger pressure for activating the valve within the aerosol container. This amount of large finger pressure is objectionable to the consumer and represents a significant disadvantage of the prior art integral foam actuators for aerosol cans.

Therefore it is an object of this invention to provide an article for use with a container having a container valve for actuating flow of container material from the container which is applicable to substantially all foam type products and compatible for use with standard aerosol valves used in the industry.

Another object of this invention is to provide an article for use with a container having a container valve for actuating flow of container material from the container having a support member and a button member with a flexible wall established therebetween enabling pivotable movement of the button member relative to the support member with reduced pressure required for activating the container valve.

Another object of this invention is to provide an article for use with a container having a container valve for actuating flow of container material from the container which article is inexpensive to manufacture and is reliable.

Another object of this invention is to provide an article for use with a container having a container valve for actuating flow of container material from the container adapted to be readily mounted to existing aerosol cans and to completely cover the mounting cup of the aerosol cans while providing sufficient clearance to fit under an over-cap.

Another object of this invention is to provide an article for use with a container having a container valve for actuating flow of container material from the container including a support member having a substantially U-shaped slot for receiving a conduit with flexible wall means interconnecting the conduit with the U-shaped slot thereby facilitating movement of a button integral with the conduit relative to the support for actuating flow of the container material.

Another object of this invention is to provide an article for use with a container having a container valve for actuating flow of container material from the container including a contoured finger portion for actuating the container valve.

Other objects of the invention will in part be obvious and will in part appear hereinafter.

SUMMARY OF THE INVENTION

The invention may be incorporated into an article for use with a container having a container valve for actuating flow of product from the container upon depression of the container valve. The article includes a support member having a bottom region engageable with the container. The support member has an upwardly extending support wall having a slot. A button member has a conduit including a first conduit portion which is cooperable with the container valve of the container in addition to a second conduit portion extending through the slot in the support wall of the support member. A flexible wall means integral with the support member and the button member enables pivotable movement of the button member relative to the support member. Accordingly, depression of the button member causes depression of the container valve to actuate flow of product to the conduit. The slot in the support member may be substantially U-shaped for receiving the second conduit portion which is established within the U-shaped slot. The flexible wall means in the preferred embodiment interconnects substantially one-half of the outer perimeter of the second conduit portion to only the curved region of the U-shaped slot.

The invention may include a recess in the support wall located substantially opposite to the slot for facilitating depression of the button member. The button member may also have a roughened region on the upper surface thereof for facilitating finger contact thereto.

Other objects and a fuller understanding of the invention may be had by referring to the detailed description taken in conjunction with the drawings and appended claims.

DETAILED DESCRIPTION

Figure 1:
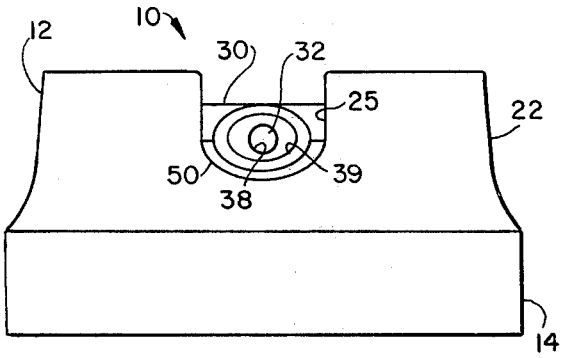
FIG. 1 is a front elevational view of a first species of foam spout for dispensing material from an aerosol container embodying the instant invention.
Figure 3:
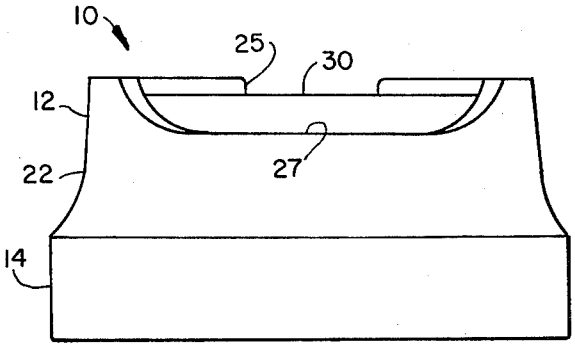
FIG. 3 is a rear elevational view of the spout shown in FIG. 1.

Similar reference characters refer to similar parts throughout the Figures. FIGS. 1–6 illustrate a first species of the instant invention which is shown as an integral actuator and nozzle for dispensing a material from a container. The actuator 10 is suitable for dispensing a foam material from an aerosol container or the like. The article 10 comprises a support member 12 having a bottom region 14 engagable with a container 15 shown in FIG. 5. A surface 17 receives an upper lip of the container 15 and spaces the article 10 relative to the container 15. A projection 18 which extends circumferentially around the bottom region projects into a groove 19 in the container 15 when the article 10 is snap locked to the aerosol container 15. A valve stem 20 extends from the container valve (not shown) into the actuator 10.

The bottom region 14 has an upwardly extending support wall 22 having a slot 25 located at one portion of the upwardly extending support wall 22 and a recess 27 located in the support wall 22 substantially opposite to the slot 25 as shown in the Figures.

Figure 4:
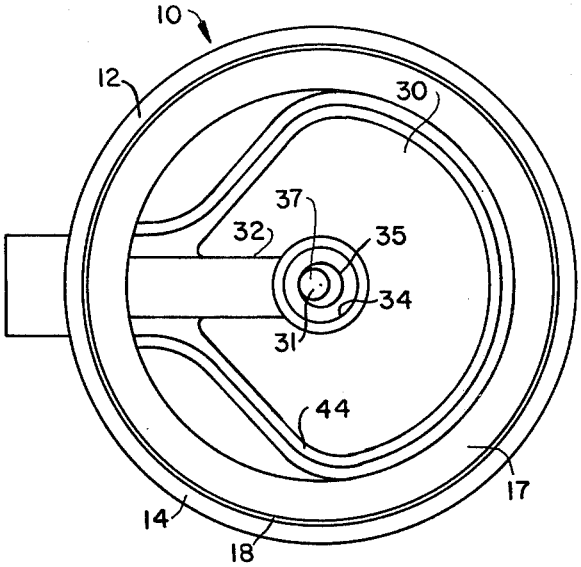
FIG. 4 is a bottom elevational view rotated 90 degrees of the spout shown in FIG. 2.

The actuator article 10 includes a button member 30 having a conduit including a first and a second conduit portion 31 and 32 respectively, for directing the container material from the container to the user. The first conduit portion 31 comprises a tapered conduit 34 communicating with a substantially cylindrical conduit 35 which receives valve stem 20 in a frictional engagement. Tapered conduit 34 insures proper seating of valve stem 20 in cylindrical conduit portion 35. The first conduit 31 communicates with the second conduit 32 through a reduced conduit portion 37. The second conduit 32 comprises a portion 38 having a substantially circular cross-sectional area communicating with a nozzle 39 having a substantially larger and oval cross-sectional area. The button member 30 includes a curved region 40 for facilitating finger contact to the button member 30. The button member 30 includes side wall means 44 extending downwardly and around the outer perimeter of the button member 30 and molded into the second conduit 32 as shown in FIG. 4. The side wall means 44 adds mechanical strength to the button member 30.

An important aspect of the instant invention relates in flexible wall means 50 which is integral with both the support member 12 and the button member 30 enabling pivotable movement of the button member 30 relative to the support member 12. The flexible wall means 50 interconnects the lower half of the second conduit 32 with only the U-shaped portion of slot 25. The reduced wall thickness of the flexible wall means 50 facilitates pivoting of the button member 30 relative to the support member 12 upon application of pressure to the curved region 40. Depression of the button member 30 activates the aerosol valve through valve stem 20 to actuate flow of the container material through conduits 31 and 32. The instant invention is applicable to both the tilt and depression activated valves. Recess 27 facilitates depression of the button member 30.

The instant invention provides an actuator article capable of activating an aerosol valve wherein the actuator 10 absorbs only a nominal force during transfer of force to the aerosol valve. In many of the prior art valve actuators, a significant amount of force was required to flex the actuator itself during activation of the aerosol valve. Many aerosol valves require a substantial force for activation. Accordingly, the additional force required for flexing a plastic actuator is a severe limitation in the prior art integral plastic actuators. The instant invention provides an integral, one-piece, actuator which can be readily manufactured of molded plastic material which has flexible wall means for enabling movement of the button member 30 relative to the support member 12 upon application of a nominal force. Satisfactory articles have been produced from polyethylene material wherein the flexible wall means 50 has a thickness of approximately 0.035 inches (0.8 mm.)

Figure 2:
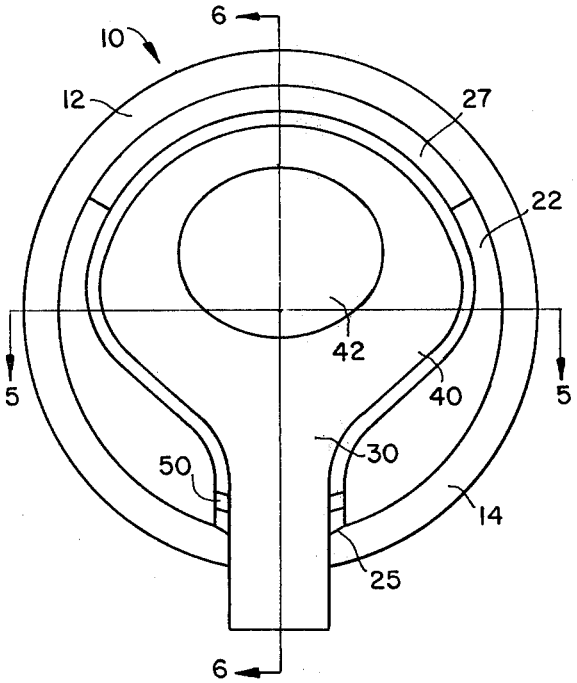
FIG. 2 is a top elevational view of the spout shown in FIG. 1.
Figure 7:
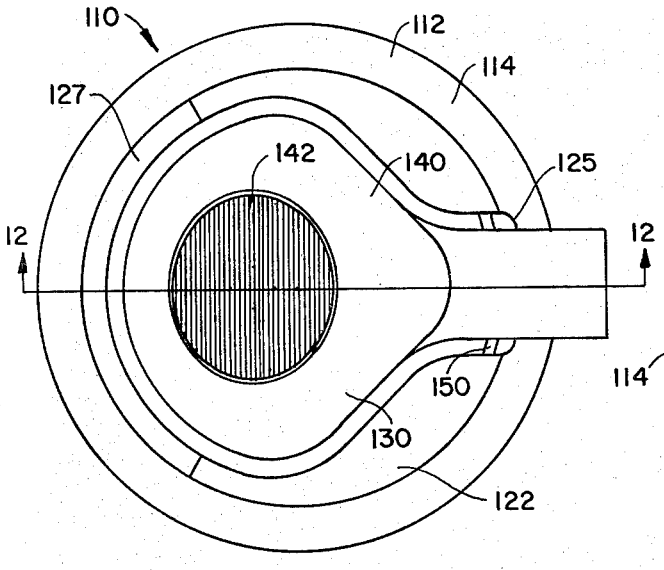
FIG. 7 is a top elevational view of a second species of foam spout for dispensing material from an aerosol container embodying the instant invention.
Figure 11:
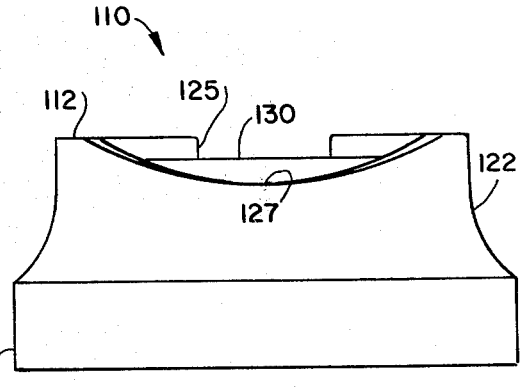
FIG. 11 is a rear elevational view of the spout shown in FIGS. 8–10.
Figure 12:
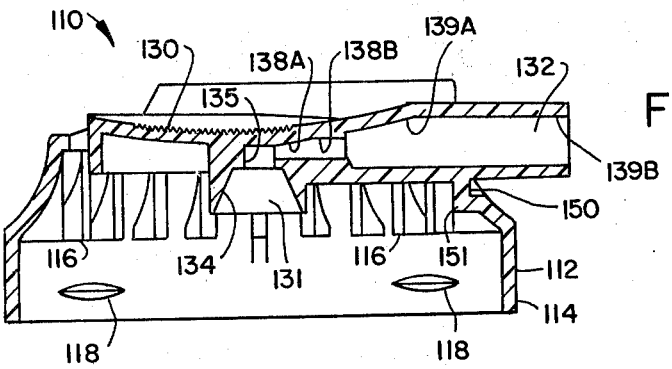
FIG. 12 is a sectional view along line 12—12 of the spout shown in FIG. 7.

FIGS. 7–14 illustrate various views of a second species of the instant invention. Parts of the second species shown in FIGS. 7–14 which are similar to parts shown in the species in FIGS. 1–6 are labeled with numbers which are 100 digits above similar parts in FIGS. 1–6. For example, the support member 12 in FIGS. 1–6 is indicated as support member 112 in FIGS. 7–14 and so forth. Similar descriptions apply to similar parts. FIG. 7 is a top view of the article 110 which is similar to the article 10 as shown in FIG. 2. A roughened region 142 is shown in FIG. 12 and magnified in FIG. 14 having a serrated surface to facilitate finger contact to the button member 130.

Figure 5:
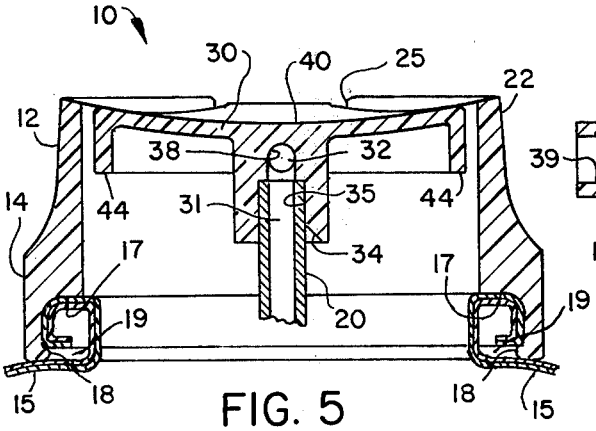
FIG. 5 is a sectional view along line 5—5 of the spout shown in FIG. 2.
Figure 6:
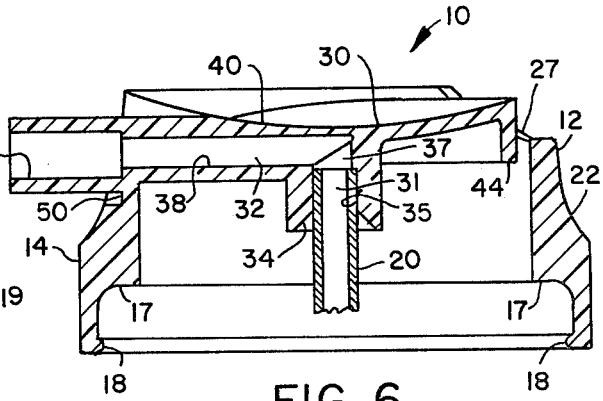
FIG. 6 is a sectional view along line 6—6 of the spout shown in FIG. 2.
Figure 8:
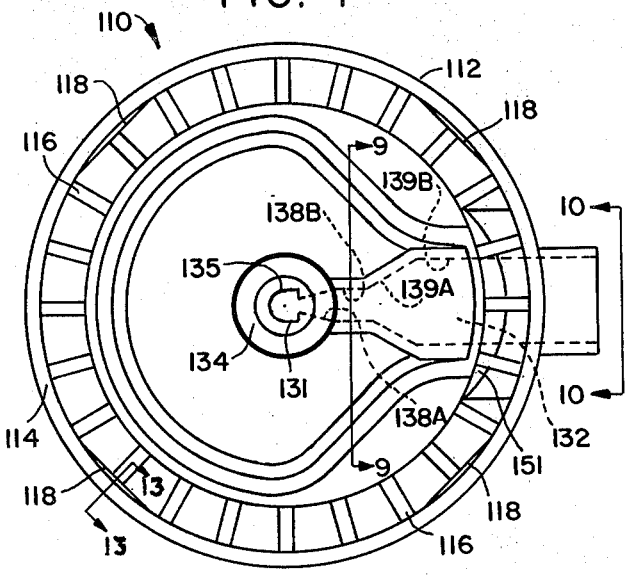
FIG. 8 is a bottom elevational view of the spout shown in FIG. 7.
Figure 13:
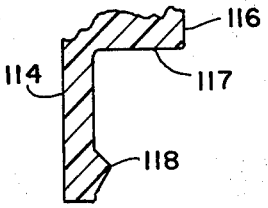
FIG. 13 is a magnified sectional view along line 13—13 of the spout shown in FIG. 8.
Figure 14:
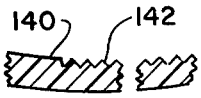
FIG. 14 is a magnified view of a portion of FIG. 12.

FIG. 8 is a bottom view of the article 110 shown in FIG. 7. In this species the support member 112 includes a plurality of ribs 116 extending substantially about all of the bottom of the support member 112. Each of the plurality of ribs 116 includes a surface 117 which cooperates with the top of a container (not shown) in a manner similar to surface 17 in FIGS. 5 and 6. A plurality of projections 118 are spaced about the internal portion of the bottom region 114 to engage with groove 19 of a container as shown in FIG. 5. FIG. 13 is a magnified sectional view along line 13—13 in FIG. 8 showing the projections 118 in greater detail.

FIGS. 8 and 12 are respectively a bottom view and a side sectional view of the second species of the article 110. FIG. 11 is substantially similar to FIG. 3. The button member 130 comprises a first conduit portion 131 including a tapered region 134 and a D-shaped region 135. The second conduit portion 132 comprises a tapered conduit 138A which communicates with a larger cylindrical conduit 138B. The conduit 138B communicates through tapered conduit 139A to an oval nozzle conduit 139B. Conduit 135 is substantially D-shaped as shown in FIG. 8 with conduit 138A tapering in the vertical direction as shown in FIG. 12 and tapering in the horizontal direction as shown in FIG. 8. The conduit 139A similarly tapers both in the vertical and the horizontal direction as shown in FIGS. 8 and 12.

Figure 9:
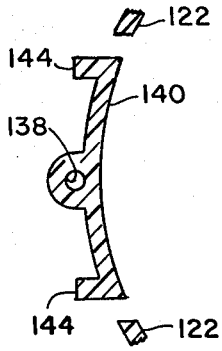
FIG. 9 is a sectional view along line 9—9 of the spout shown in FIG. 8.
Figure 10:
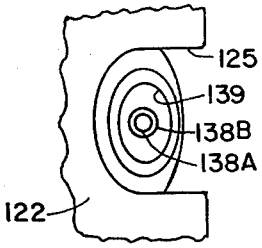
FIG. 10 is a partial elevational view along line 10—10 of the spout shown in FIG. 8.

FIG. 9 is a sectional view along line 9—9 in FIG. 8. The region of conduit 138B of the second conduit 132 is substantially circular in cross sectional area. FIG. 10 is an elevational view of a portion of article 110 along line 10—10 in FIG. 8 showing in greater detail the oval cross-section of conduit 139B.

The flexible wall means 150 shown in FIGS. 7, 8 and 12 is substantially similar to the flexible wall 50 in FIGS. 1–6. In this embodiment the flexible wall is approximately 0.015 inches (0.38 mm.) in thickness and has a reinforced portion 151 located adjacent the flexible wall 150 to add mechanical strength to the article 110.

The invention as disclosed provides an improved actuator article capable of being mass produced of a single molded piece of plastic and having the further advantage of requiring minimum pressure for movement of the button member relative to the support member. The actuator 10 is suitable for use with both the depression and tilt type aerosol valves as well known in the art. The flexible wall means in addition to providing a minimum resistance provides a rugged integral connection between the button member and the support member to provide a unitary and integral actuator article.

The container dispensing article has been disclosed as an actuator for cooperation with either a hollow or solid valve stem as is well known in the art. The actuator may be fastened to the mounting cup of a container 15 as shown in FIG. 5 or may be fastened to the outside rim of the container as is also well known in the art.

The present disclosure includes that contained in independent claims, as well as that of the foregoing description. Although this invention has been described in its preferred form with a certain degree of particularity, it is understood that the present disclosure of the preferred form has been made only by way of an example and that numerous changes in the details of the construction and the combination and arrangement of parts may be resorted to without departing from the spirit and scope of the invention as hereinafter claimed.

Now that the invention has been described;

What is claimed is:

1. An integral article for use with a container having a container valve for actuating flow of product from the container upon movement of the container valve, comprising in combination:

a support member having a bottom region engageable with the container;

said support member comprising an upwardly extending support wall;

said upwardly extending support wall having a slot extending therethrough;

a button member having a conduit including a first conduit portion and a second conduit portion;

said first conduit portion being cooperable with the container valve for actuating flow and receiving product from the container;

said second conduit portion communicating with said first conduit portion and forming a nozzle for the product;

said second conduit portion extending through said slot in said upwardly extending support wall;

flexible wall means enabling pivotal movement of said button member relative to said support member about said second conduit portion whereby depression of said button member causes movement of the container valve to actuate flow of product through said conduit to be discharged through said nozzle;

said flexible wall means comprising a substantially wall extending upwardly within and from the bottom of said slot to contact said second conduit portion of said button member; and said flexible wall means being integral with said support member and said second conduit portion and having a reduced wall thickness relative to adjacent areas of said support member thereby requiring reduced pressure for pivoting said button member.

2. An integral article for use with a container having a container valve for actuating flow of product from the container upon movement of the container valve, comprising in combination:

a support member having a bottom region engageable with the container;

said support member comprising an upwardly extending support wall;

said upwardly extending support wall having a slot extending therethrough;

a button member having a conduit including a first conduit portion and a second conduit portion;

said first conduit portion being cooperable with the container valve for actuating flow and receiving product from the container;

said second conduit portion communicating with said first conduit portion and forming a nozzle for the product;

said second conduit portion extending through said slot in said upwardly extending support wall;

flexible wall means enabling pivotal movement of said button member relative to said support member about said second conduit portion whereby depression of said button member causes movement of the container valve to actuate flow of product through said conduit to be discharged through said nozzle;

said flexible wall means comprising a substantially planar wall extending upwardly within and from the bottom of said slot to contact said second conduit portion of said button member;

said flexible wall means being integral with said support member and said second conduit portion and having a reduced wall thickness relative to adjacent areas of said support member thereby requiring reduced pressure for pivoting said button member;

said slot of said support member being substantially U-shaped for receiving said second conduit portion;

said second conduit portion being established within said U-shaped slot; and said flexible wall means interconnecting substantially one-half of the outer perimeter of said second conduit portion to said U-shaped slot.

3. An article as set forth in claim 2, wherein said flexible wall means connects only the lower half of said second conduit portion to only the curved region of said U-shaped slot.

4. An integral article for use with a container having a container valve for actuating flow of product from the container upon movement of the container valve, comprising in combination:

a support member having a bottom region engageable with the container;

said support member comprising an upwardly extending support wall;

said upwardly extending support wall having a slot extending therethrough;

a button member having a conduit including a first conduit portion and a second conduit portion;

said first conduit portion being cooperable with the container valve for actuating flow and receiving product from the container;

said second conduit portion communicating with said first conduit portion and forming a nozzle for the product;

said second conduit portion extending through said slot in said upwardly extending support wall;

flexible wall means enabling pivotal movement of said button member relative to said support member about said second conduit portion whereby depression of said button member causes movement of the container valve to actuate flow of product through said conduit to be discharged through said nozzle;

said flexible wall means comprising a substantially planar wall extending upwardly within and from the bottom of said slot to contact said second conduit portion of said button member;

said flexible wall means being integral with said support member and said second conduit portion and having a reduced wall thickness relative to adjacent areas of said support member thereby requiring reduced pressure for pivoting said button member;

said second conduit portion having a substantially elongated cross-sectional area;

said slot of said support member being substantially U-shaped for receiving said second conduit portion therein; and said flexible wall means interconnecting only the lower half of said second conduit portion to only the curved region of said U-shaped slot for facilitating pivotal movement of the upper half of said second conduit portion on said flexible wall means.

* * * * *